US006786341B2

(12) United States Patent
Stinnett et al.

(10) Patent No.: US 6,786,341 B2
(45) Date of Patent: Sep. 7, 2004

(54) ARTICLE DISPENSING APPARATUS

(76) Inventors: Harold K. Stinnett, 1025 Chestnut Mountain Dr., Vinton, VA (US) 24179; William A. Stinnett, 22731 Clearwater Ct., Apt. 201, Novi, MI (US) 48375

( * ) Notice: Subject to any disclaimer, the term of this patent is extended or adjusted under 35 U.S.C. 154(b) by 0 days.

(21) Appl. No.: 10/190,564

(22) Filed: Jul. 9, 2002

(65) Prior Publication Data

US 2004/0007546 A1 Jan. 15, 2004

(51) Int. Cl.[7] ..... A47F 1/04
(52) U.S. Cl. ..... 211/59.2; 211/194
(58) Field of Search ..... 211/59.2, 194; 312/35, 42, 45, 60, 72; 221/97, 98, 102, 194, 195, 266, 268, 68, 93, 241

(56) References Cited

U.S. PATENT DOCUMENTS 1,113,476 A * 10/1914 Osmer ..... 221/131
2,504,733 A * 4/1950 Safranski ..... 221/183
2,511,099 A * 6/1950 Case ..... 221/123
2,818,978 A * 1/1958 Post ..... 211/59.2
2,852,327 A 9/1958 Mason
2,956,660 A * 10/1960 Nordquist ..... 194/346
3,066,827 A * 12/1962 Pryor ..... 221/199
D198,889 S 8/1964 Heselov
3,248,008 A * 4/1966 Meierjohan ..... 221/205
3,254,792 A 6/1966 Danielson et al.
3,286,846 A * 11/1966 Brandes ..... 211/59.2
4,308,974 A 1/1982 Jones
4,456,147 A * 6/1984 Tominaga ..... 221/67
4,498,569 A * 2/1985 Tanaka et al. ..... 193/27
4,712,712 A 12/1987 Garden
4,729,480 A * 3/1988 Groover et al. ..... 211/59.2
4,744,489 A * 5/1988 Binder et al. ..... 221/6
4,779,760 A * 10/1988 Wittern et al. ..... 221/283
4,834,263 A 5/1989 Becze
4,913,313 A * 4/1990 Rockola ..... 221/131
4,997,106 A * 3/1991 Rockola ..... 221/95
D316,496 S 4/1991 Diamond
5,009,329 A 4/1991 Farrentine
5,080,256 A * 1/1992 Rockola ..... 221/109
5,228,590 A 7/1993 Blasko et al.
5,295,608 A 3/1994 Blasko et al.
5,356,033 A 10/1994 Delaney
5,361,937 A * 11/1994 Wiese ..... 221/189
5,462,198 A 10/1995 Schwimmer
5,680,744 A 10/1997 Kramedjian et al.
5,743,430 A 4/1998 Freixas
D450,222 S 11/2001 Dewitt
D473,398 S * 4/2003 Stinnett et al. ..... D6/408

* cited by examiner

*Primary Examiner*—Jennifer E. Novosad

(57) ABSTRACT

An article dispensing apparatus includes a bin for storing articles to be dispensed therefrom. The bin includes front, rear, left, right, top and bottom, and an adjustable ramp for accommodating articles of various sizes. The storage capacity of the bin can be increased by adding one or more expansion bins.

46 Claims, 10 Drawing Sheets

ARTICLE DISPENSING APPARATUS

BACKGROUND OF THE INVENTION

The present invention is generally directed to article dispensing apparatus, and more particularly to a modular article dispensing apparatus which can store and dispense articles or products of various sizes.

In retail environment, an important aspect of marketing is visual reinforcement of the products to appeal to the buying consumers. Applying enhanced display of the products is becoming increasingly critical in retail marketing, as the number of products being marketed continues to grow and as the consumers are being constantly challenged to select and purchase from a growing number of competing products. This presents an interesting, yet challenging dilemma to the retailers who typically have fixed shelf space, but need to constantly display a growing number of competing products on one hand, and to provide sufficient display space to different types of products, on the other hand. In this regard, it is not uncommon to see different types of product display and dispensing devices, each custom designed and constructed to accommodate a specific item. This requires manipulation and arrangement of multiple dispensing devices, all competing for the same shelf space. In addition, since multiple dispensing devices have to be arranged in a limited space, retailers are forced to assign priority of displaying one item over another, thereby reducing visibility of the omitted items. All of this adds to more marketing dilemma for a retailer in an already very challenging market.

In summary, conventional dispensing devices are generally custom designed and constructed to dispense only a specific item. In other words, their design and construction is not versatile to accommodate different sized products for home, retail, institutional, and/or industrial environment.

Therefore, there is a need in the industry for an article dispensing apparatus, which can be easily used to display and dispense articles of various sizes.

Examples of various dispensers and vending machines are disclosed in U.S. Pat. Nos. 2,852,327; 3,254,792; 4,712,712; 4,834,263; 5,009,329; 5,228,590; 5,356,033; 5,462,198; 5,680,744; 5,743,430; and, Des. 198,889.

OBJECTS AND SUMMARY OF THE INVENTION

The principal object of the present invention is to provide an article dispensing apparatus which overcomes the drawbacks associated with conventional dispensing devices.

An object of the present invention is to provide an article dispensing apparatus which can be used to display and dispense articles of various sizes for the home, retail, institutional, and/or industrial environment.

Another object of the present invention is to provide an article dispensing apparatus which includes a modular, scalable storage unit (or bin) for near-sequentially delivering articles of various sizes.

Yet another object of the present invention is to provide an article dispensing apparatus which dispenses products on a near first-in, first-out basis. Inventory rotation assures that time-sensitive products are moved properly and are continually in-view.

Still yet another object of the present invention is to provide an article dispensing apparatus which can be easily constructed from an injection-molded thermoplastic material. When molded from a clear or transparent material, such as polystyrene or polycarbonate, product display is accentuated, and product inventory accounting (on-shelf stock) can be more readily achieved.

An additional object of the present invention is to provide an article dispensing apparatus wherein the storage capacity of a single base or primary unit (dispensing bin) can be easily scaled with the addition of single or multiple expansion units or bins, vertically scaled to minimize floor or counter space. With the addition of expansion or secondary units, products can be front-loaded into the apparatus without sliding or otherwise moving the entire unit or assembly. As a result, time and convenience in loading of the products is significantly improved.

Yet an additional object of the present invention is to provide an article dispensing apparatus which is flexible enough to function as a standalone counter-top dispenser, a slide-out drawer unit, a wall-mounted container, or a linear or two-dimensional storage array.

Still yet an additional object of the present invention is to provide an article dispensing apparatus wherein a pivoting ramp is provided in the dispensing bin that is both adjustable and removable to accommodate products of different size and shape and optimize product flow capability.

A further object of the present invention is to provide an article dispensing apparatus which has sufficient strength to support vertical nesting or stacking of both expansion bins and additional dispensing bins to maximize space efficiency. The article dispensing apparatus is further versatile in that lateral nesting of the dispensing and expansion bins is possible, resulting in a strong array of bins with a minimum of shelving interleaves. Therefore, multi-celled configurations, both in vertical and horizontal directions, are possible.

Yet a further object of the present invention is to provide an article dispensing apparatus wherein removable, re-configurable access doors and lids may be optionally provided for product security and protection from dust and other contaminants.

Still yet a further object of the present invention is to provide an article dispensing apparatus which is simple in design, construction and configuration and does not require any additional mechanism for sequentially feeding of the products, since the products preloaded into either an expansion bin or a dispensing bin are fed by gravity and guided by their respective ramps to the dispensing opening.

Still yet a further object of the present invention is to provide an article dispensing apparatus wherein the adjustable ramp in the dispensing bin optimizes the flow of different-sized products. The products are manually removed at the front catch of the return ramp and, upon removal, a near-sequential flow is initiated until products again come into contact with the front catch.

Another object of the present invention is to provide an article dispensing apparatus which can be easily used to display and dispense products, such as hardware, pens, markers, bulk produce/candy, medical supplies, electrical supplies/connectors, cylindrical or small miscellaneous products. The article dispensing apparatus of the present invention can be used in a wide spectrum of marketing areas, such as hardware stores, convenience stores, industrial supply stores, electrical supply stores, home improvement stores, grocery stores, art/craft stores, auto parts stores, medical supply/hospitals/clinics, restaurants, etc.

Yet another object of the present invention is to provide an article dispensing apparatus which can be molded in clear or opaque plastic, and can be further colored-coded based on the type of product contained therein thereby providing a visual indication for the ease of location and selection of the products, particularly to the consumers.

In summary, the main object of the present invention is to provide an article dispensing apparatus which is modular, simple in construction, scalable for near-sequentially delivering various sized products for the home, retail, institutional, and/or industrial environment.

In accordance with the present invention, an article dispensing apparatus, includes a bin for storing articles to be dispensed therefrom. The bin includes front, rear, left, right, top and bottom, and an adjustable ramp for accommodating articles of various sizes.

BRIEF DESCRIPTION OF THE DRAWINGS

The above and other objects, novel features and advantages of the present invention will become apparent from the following detailed description of the invention, as illustrated in the drawings, in which.

DETAILED DESCRIPTION OF THE INVENTION

Figure 1:
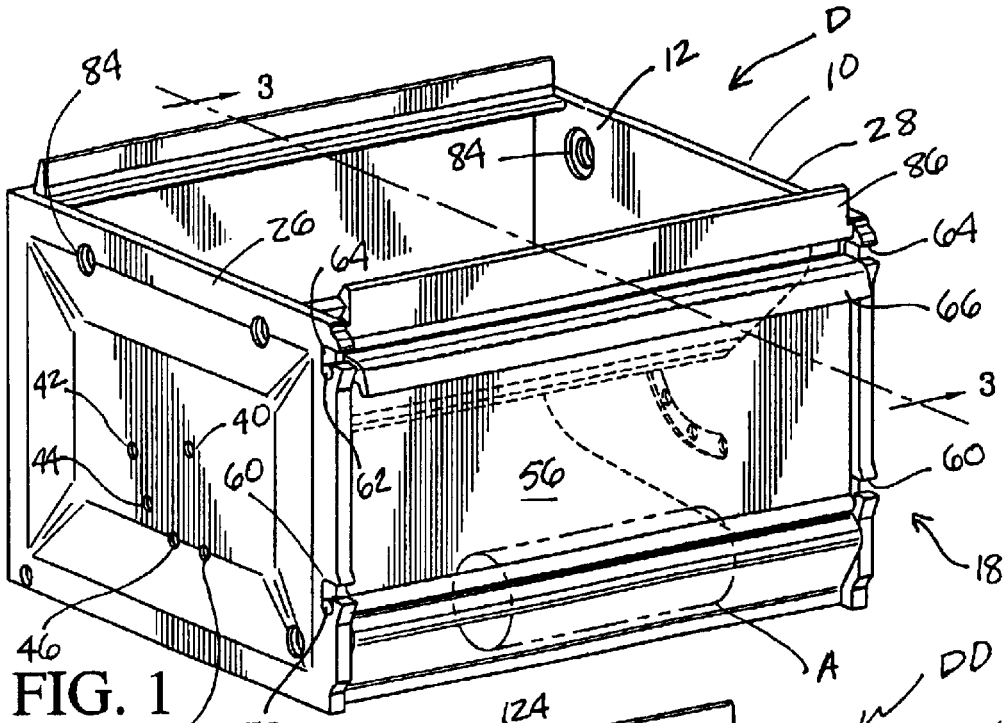
FIG. 1 is a perspective view of an article dispensing apparatus in accordance with the present invention.
Figure 3:
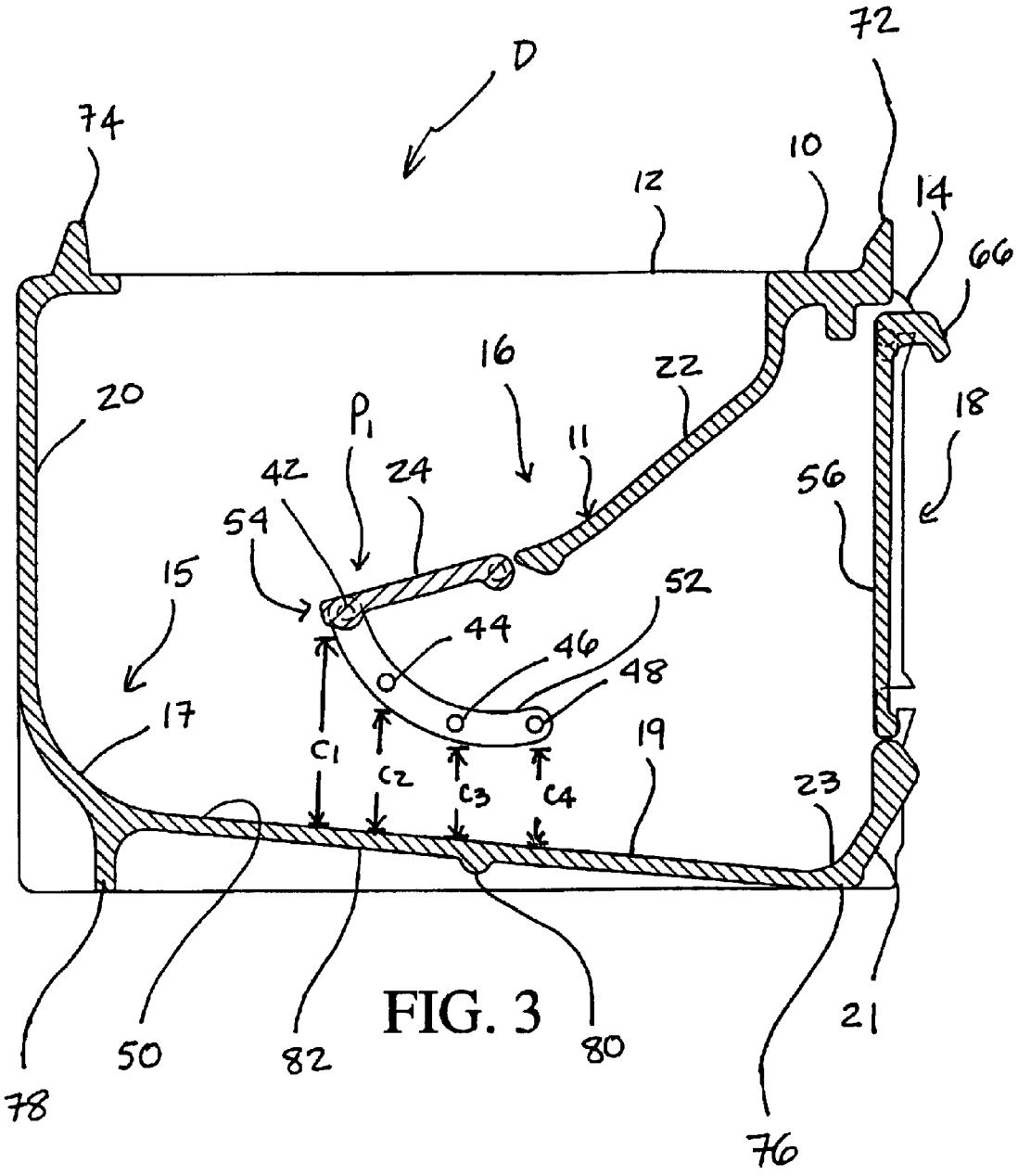
FIG. 3 is an enlarged sectional view taken along line 3—3 of FIG. 1.

With reference to FIGS. 1 and 3, the article dispensing apparatus D of the present invention is in the form of a dispensing cell or bin 10, preferably including a top opening 12 and a front opening 14. Preferably, the article dispensing apparatus D is made from an injection molded, generally opaque thermoplastic material. In the alternative, the apparatus D can be made from a clear material, such as polystyrene or polycarbonate. Other suitable material may also be used to make an opaque or clear dispensing apparatus D.

As best shown in FIG. 3, a feeder ramp 16 extends downwardly from adjacent the front 18 of the bin 10 towards the rear wall 20 thereof. The feeder ramp 16 includes a fixed panel 22 and a pivotally adjustable panel 24. Both the fixed panel 22 and the adjustable panel 24 generally span the width of the bin 10 between left and right walls 26 and 28 thereof, and together form a generally continuous ramp surface 11.

The bin 10 further includes a return ramp 15 with a curved portion 17, and a generally planar portion 19 inclined downwardly from the rear wall 20 towards the front 18 at an angle of about 4–9°, and preferably 5°. The curved portion 17 has a radius of curvature of 0.75–1.5 inches, and preferably 1 inch. The return ramp 15 also functions as the bottom of the bin 10.

The return ramp 15 generally terminates at a forwardly inclined front catch 21 with a curved portion 23 of a radius of curvature of about 0.25–0.625 inch, and preferably 0.344 inch. The front catch 21 has a height of about 0.65–1.40 inches, and preferably 1 inch. The catch 21 functions as a barrier or stop for the articles A.

The fixed panel 22 of the feeder ramp 16 is downwardly inclined at an angle of about 30–60°, and preferably 40°, from the horizontal plane HP.

Figure 16:
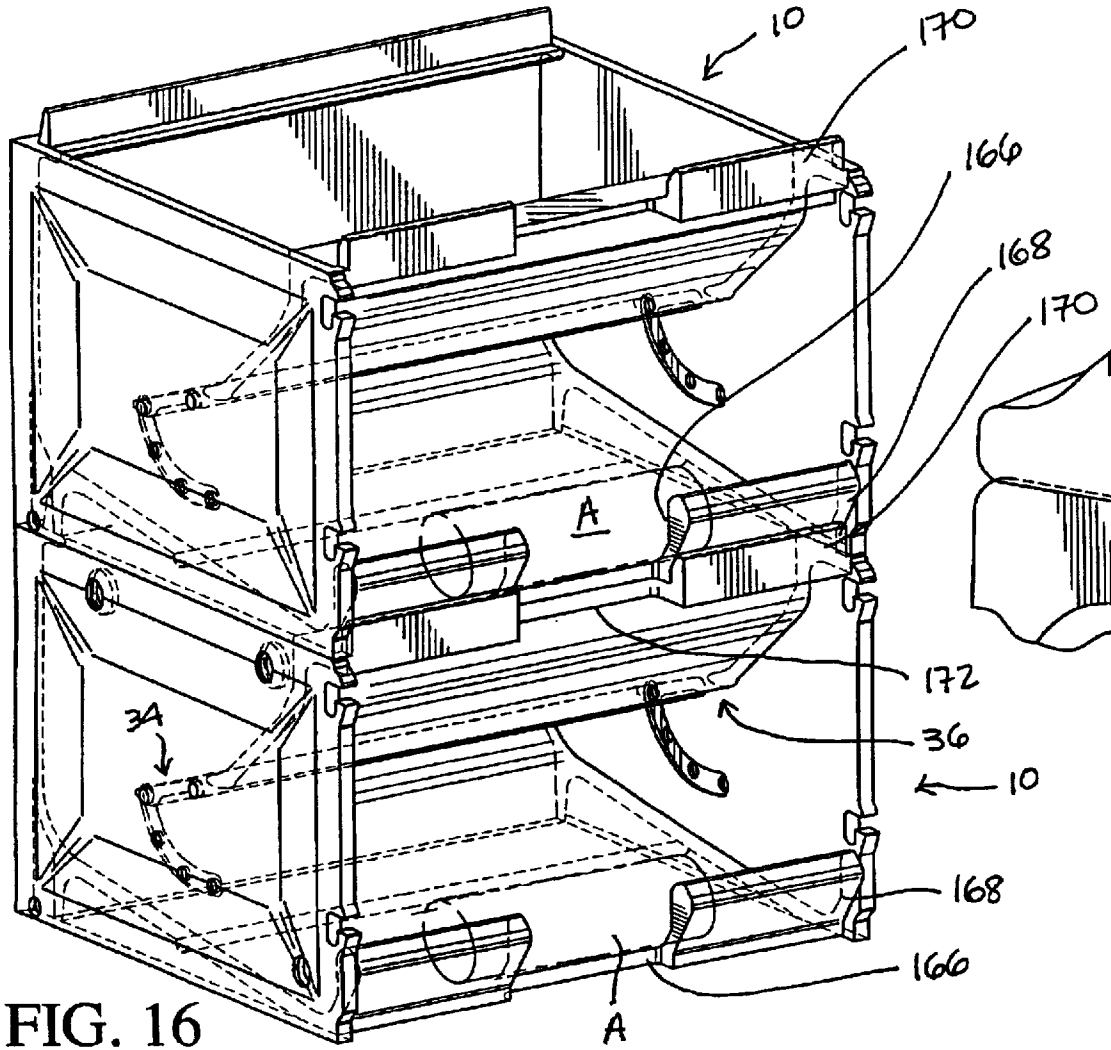
FIG. 16 is a view similar to FIG. 14, showing a vertical array of the base or dispensing units.

As best shown in FIGS. 3 and 11–13, the adjustable ramp panel 24 includes a pivot pin 30 and a guide pin 32 on both side ends 34 and 36 thereof (FIG. 16). Both the left and right walls 26 and 28 of the bin 10 include a mounting hole 40 and preferably four ramp locator guide holes 42, 44, 46 and 48 (FIGS. 1 and 3). The guide holes 42, 44, 46 and 48 designate first (uppermost), second, third and fourth (lowermost) positions $P_1$, $P_2$, $P_3$, and $P_4$, respectively, of the adjustable ramp panel 24.

Figure 11:
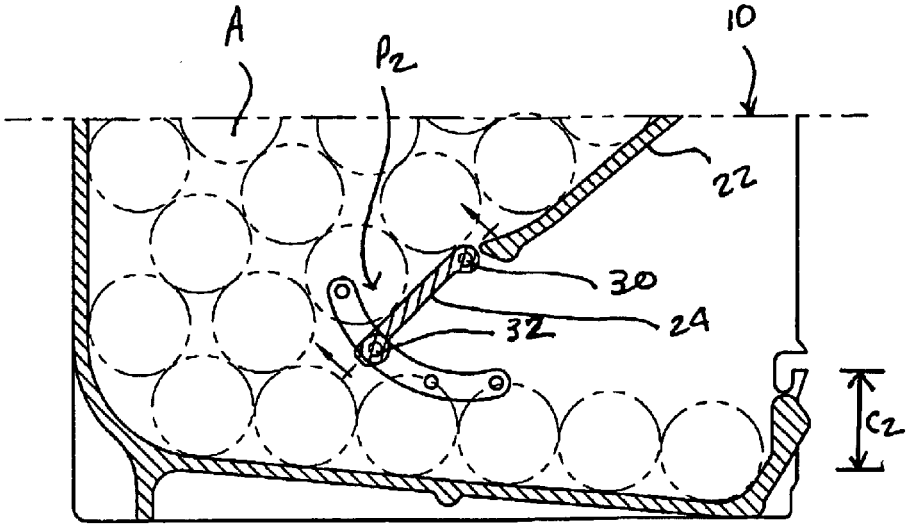
FIG. 11 is a view similar to FIG. 3, showing one position of the adjustable ramp.
Figure 12:
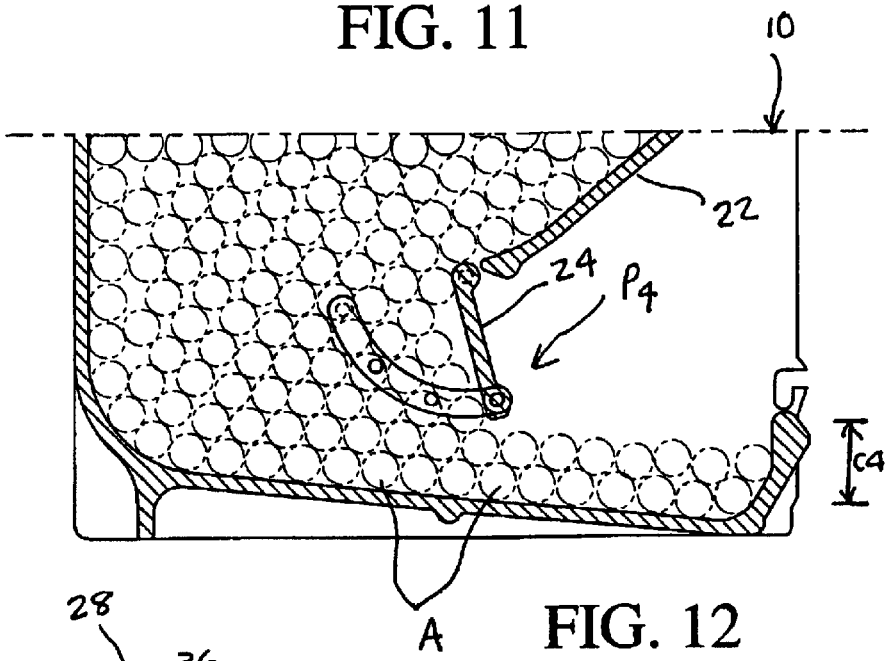
FIG. 12 is a view similar to FIG. 11, showing another position of the adjustable ramp.
Figure 13:
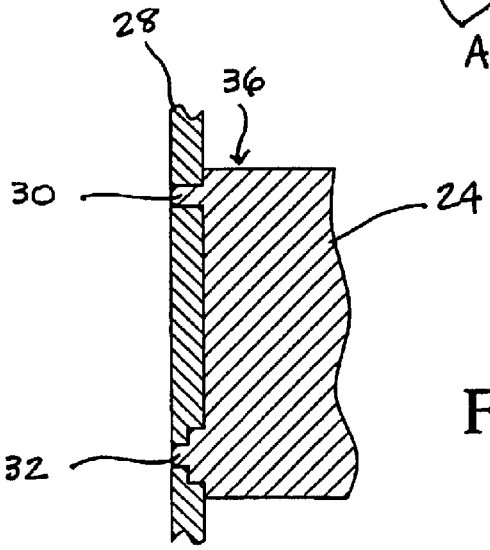
FIG. 13 is an enlarged sectional view taken along line 1313 of FIG. 11.

The pivot pins 30, on the left and right side ends 34 and 36 of the adjustable panel 24, are received in corresponding mounting holes 40, and the guide pins 32 are selectively received in one of the guide holes 42, 44, 46 or 48. It is noted herewith that the mounting hole 40 and the ramp locator guide holes 42, 44, 46 and 48 on the left wall 26, are aligned with the corresponding mounting and ramp locator guide holes in the right wall 28 of the bin 10. Therefore, by rotating or pivoting the adjustable panel 24 about the pivot pins 30, and locating the guide pins 32 in one of the guide holes 42, 44, 46 or 48, the position of the adjustable panel 24 relative to the fixed panel 22, or the inside bottom surface 50 of the bin 10 (or the planar portion 19 of the return ramp 15) 44 can be varied (FIGS. 11–12). Alternatively, the adjustable panel 24 may be removed altogether to accommodate large articles.

Preferably, guide holes 42, 44, 46 and 48 are arranged along a curved line 52 at about 30° intervals, such that a total adjustment of up to about 90° is provided between the first position $P_1$ and the fourth position $P_4$. As best shown in FIG. 3, in the uppermost or first position $P_1$, the adjustable panel 24 is preferably downwardly inclined at an angle of about 10–20° , and preferably 15° from the horizontal. As a result, a total angular adjustment of 100–110° from the horizontal, is provided for the adjustable ramp panel 24.

In the uppermost or first position $P_1$ of the adjustable ramp panel 24, shown in FIG. 3 (where the guide pins 32 are received in the first set of guide holes 42), a clearance $C_1$ exists between the free end 54 of the adjustable panel 24 and the bottom surface 50 of the bin 10. However, as the ramp panel 24 is adjusted successively downwardly through the positions $P_2$, $P_3$, and $P_4$, the clearance $C_1$ is reduced successively to attain values $C_2$, $C_3$, and $C_4$, respectively. In other words, the clearance $C_1$ is greater than $C_2$, clearance $C_2$ is greater that $C_3$, and clearance $C_3$ is greater than $C_4$. This arrangement allows for accommodating articles A of various sizes. For instance, the uppermost or first position $P_1$ of the adjustable panel 24 (shown in FIG. 3), would allow accommodating an article A, the diameter of which is less than the clearance $C_1$ (FIG. 15), and the lowermost or fourth position $P_4$ of the adjustable panel 24 (FIG. 12) would allow accommodating an article A, the diameter of which is less than the clearance $C_4$. (It is noted herewith that the number and arrangement of guide holes 42, 44, 46 and 48, and the relative distance thereof with the bottom surface 50, can be varied, as desired, to provide the flexibility of accommodating articles of different sizes).

As shown in FIGS. 1 and 3, a front door 56 may be optionally provided to protect the articles A from dust or other contamination. The front door 56 includes a hinge pin 58 on both sides of the lower end thereof, which are pivotally snap-fitted into corresponding lower grooves 60 in the bin 10. The door 56 further includes a latch pin 62 on both sides of the upper portion thereof to be releasably received in corresponding upper grooves 64 of the bin 10. The door 56 can be opened by pulling on the front handle 66 and pivoting at the lower hinge pins 58.

The bin 10 further includes upper, front and rear constraints 72 and 74, and lower, front and rear stacking guides 76 and 78, to provide vertical stackability (FIG. 3). A locator pin or rib 80 may preferably be provided on the bottom exterior 82 of the bin 10 for reinforcement.

In order to connect two or more bins 10 together in a side-by-side relationship, connection holes 84 may be provided in left and right walls 26 and 28 to receive conventional binder screws or other fasteners (not shown).

The bin 10 is further preferably provided with a generally planar facade 86 for attaching a label with indicia about the articles, or other desired information.

Figure 17:
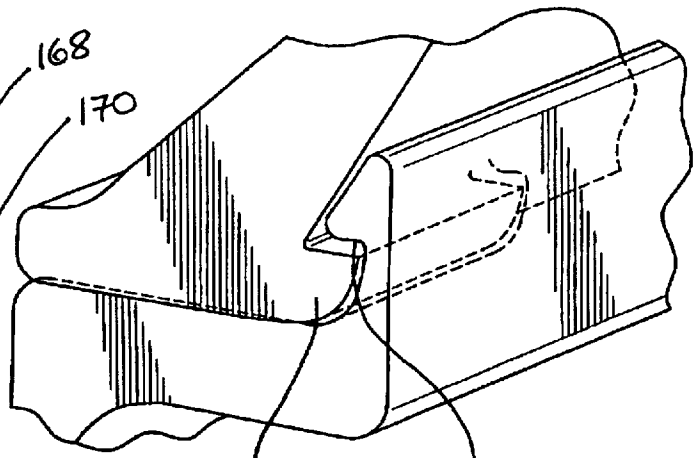
FIG. 17 is an enlarged view showing snap-fit arrangement between a base or dispensing unit and an expansion unit.
Figure 18:
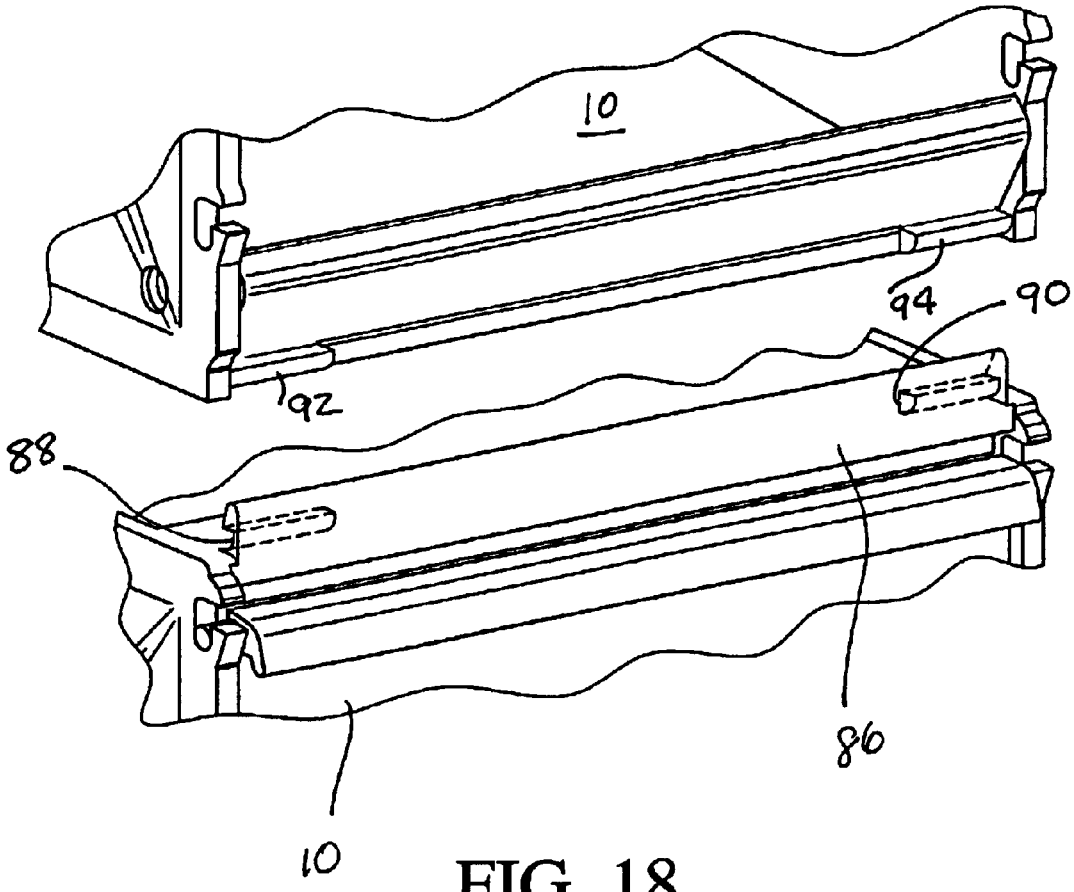
FIG. 18 illustrates the snap-fit components on the base and expansion units.

In order to provide a stable and sturdy unit constructed by stacking individual bins 10, preferably two laterally disposed, left and right recesses (female connecting members) 88 and 90, are provided in the rear of facade 86 for snap-fitting corresponding male connecting members 92 and 94 provided adjacent the bottom front of another bin 10 (FIGS. 17–18). The male and female connecting members 92, 94 and 88, 90, when interconnected, prevent vertical as well as horizontal movement between the bins 10.

Figure 2:
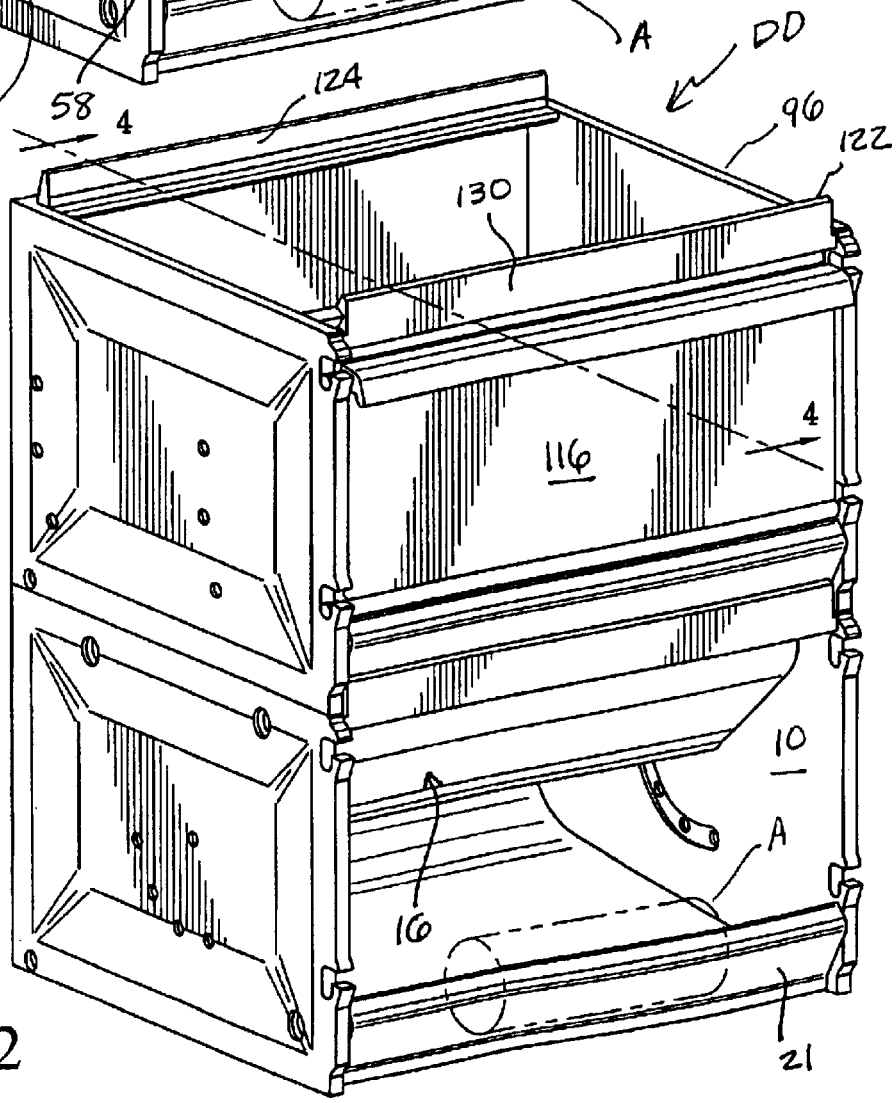
FIG. 2 is a second embodiment of an article dispensing apparatus in accordance with the present invention.
Figure 4:
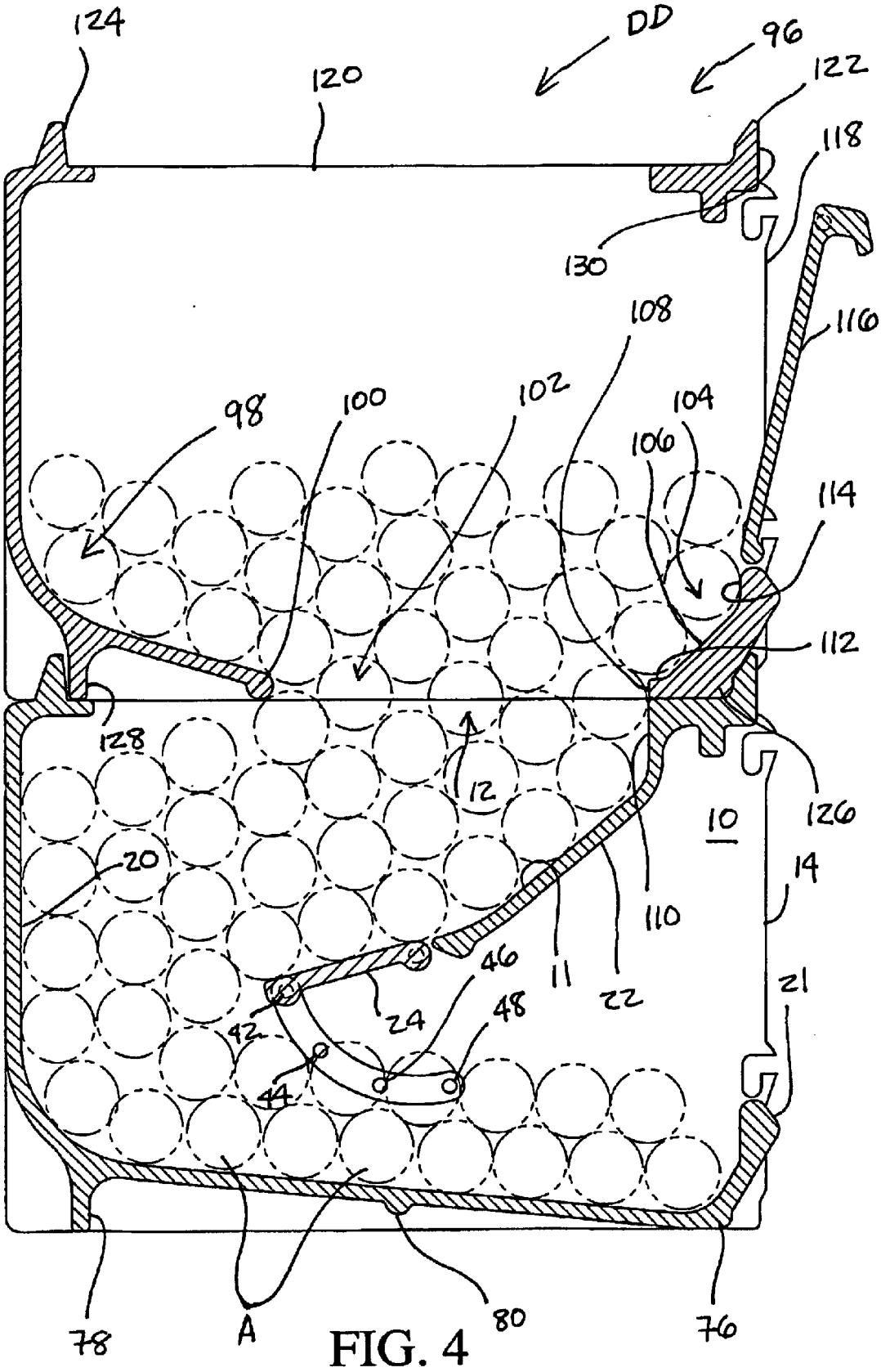
FIG. 4 is an enlarged sectional view taken along line 4—4 of FIG. 2.

Referring now to FIGS. 2 and 4, which disclose a second embodiment of the article dispensing apparatus DD that is similar to the embodiment shown in FIGS. 1 and 3, except that an expansion bin 96 is provided atop the lower base unit or dispensing bin 10, described above with reference to FIGS. 1 and 3. (It is noted herewith that like parts in various embodiments described below have been designated with the same reference numerals.)

The expansion bin 96 has the same general overall configuration and is molded in the like manner as the dispensing bin 10. As best shown in FIG. 4, the expansion bin includes a return ramp 98 that terminates at a reinforcing rib 100. A bottom opening 102 in the expansion bin 96 is in general alignment with the top opening 12 of the bin 10, to facilitate downward flow of the articles A into the bin 10 by gravity. Preferably, the return ramp 98 has the same general radius of curvature as the return ramp 15 of the bin 10.

The expansion bin 96 includes a feeder ramp 104 having a downwardly inclined surface 106 which is generally parallel to the ramp surface 11 of the feeder ramp 16 in the lower bin 10. The ramp surfaces 106 and 11 are connected by generally vertical ramp surfaces 108 and 110 of the feeder ramps 16 and 104, respectively. The feeder ramp 104 further includes a generally horizontal ramp surface 112 between ramp surfaces 110 and 108. The upper portion of the feeder ramp 104 includes a slightly curved surface 114 to guide the articles A down on the main ramp surface 106.

The expansion bin 96 is optionally provided with a front door 116 to open or close the front opening 118 thereof. The door 116 is similar in construction and operation to the front door 56 discussed above with reference to the dispensing bin 10.

The expansion bin 96 further includes a top opening 120 which may be left open to facilitate filling thereof with the articles A, or may be closed by providing a suitable lid or cover (not shown) that would fit between the upper, front and rear constraints 122 and 124. The bottom of the expansion bin 96 is also provided with lower, front and rear guides 126 and 128 that interfit with upper, front and rear constraints 72 and 74 of the bin 10.

In order to stabilize the expansion bin 96 on the bin 10, the expansion bin 96 would also be provided with male connecting members 92 and 94 (FIG. 18) that interfit with female connecting members 88 and 90 of the bin 10. A front facade 130, similar to the facade 86 on the lower bin 10, is also provided on expansion bin 96 to provide additional space for attaching labels or other indicia regarding the articles, or as desired.

Figure 5:
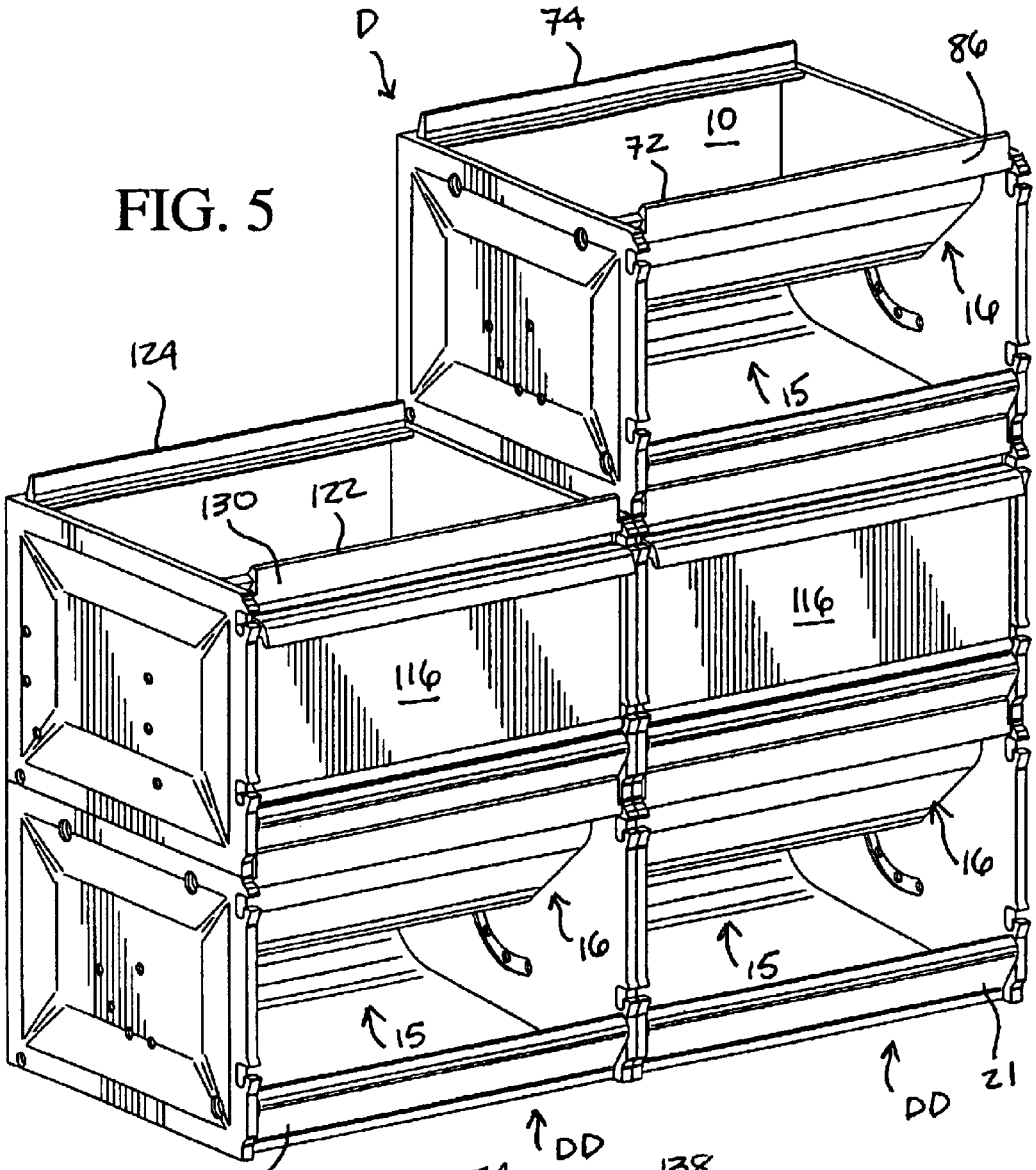
FIG. 5 illustrates a modular array flexibility of the article dispensing apparatus shown in FIGS. 1 and 2.

FIG. 5 illustrates an arrangement wherein two article dispensing apparatus DD are disposed in a side-by-side relationship, and a dispensing bin 10 (without the front door) is stacked atop one of the apparatus DD. It is noted herewith that various combinations of the article dispensing apparatus D and DD, shown in FIGS. 1 and 2, can be achieved. It is, however, preferred that the base of a vertical nesting unit start with the dispensing bin 10, above which any combination of dispensing and expansion bins 10 and 106, respectively, can be achieved.

Figure 7:
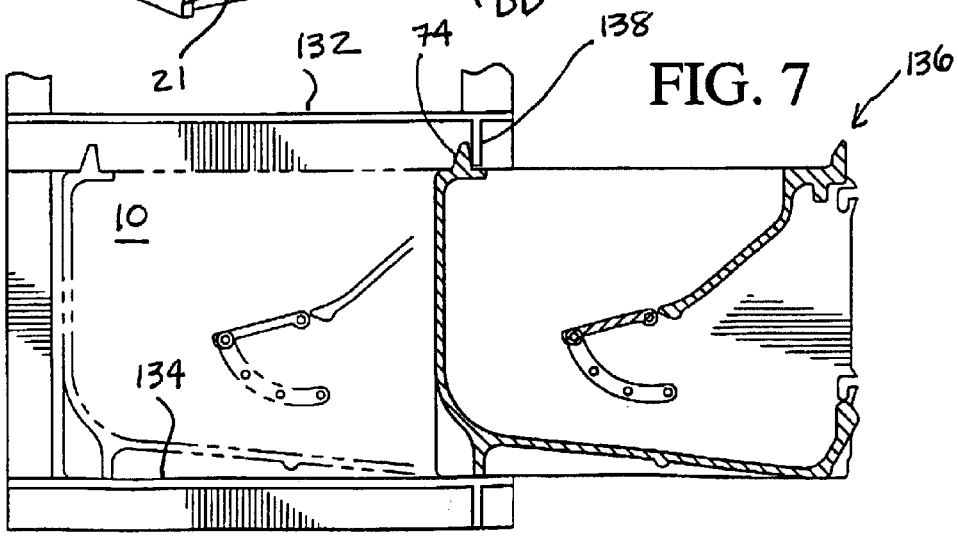
FIG. 7 is a partial cross-sectional view taken along line 7—7 of FIG. 6.
Figure 6:
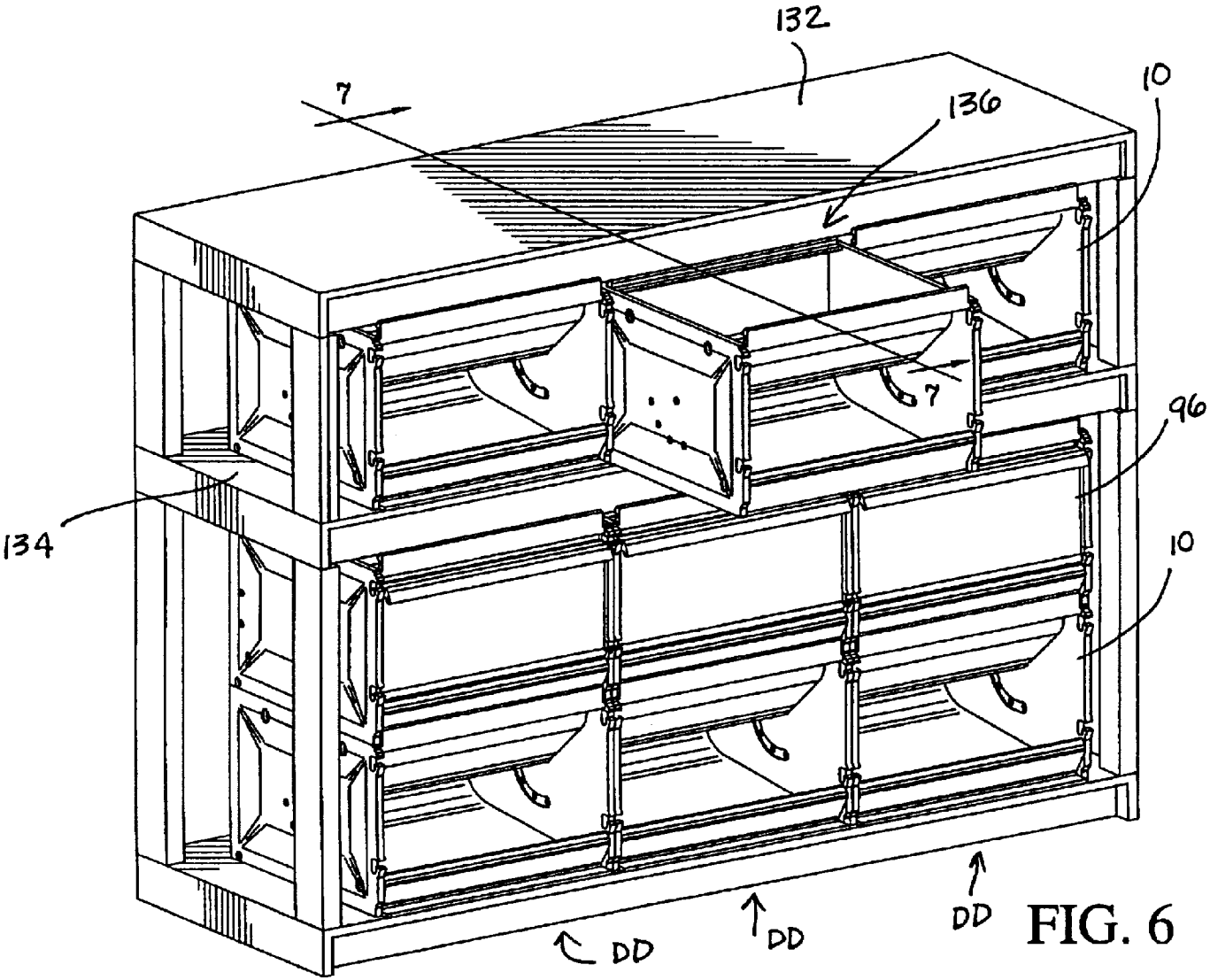
FIG. 6 illustrates a preferred array showing the article dispensing apparatus of FIGS. 1 and 2, wherein one (or more) of the bins is slidable in the form of a drawer.

FIGS. 6–7 illustrate an arrangement wherein the dispensing bins 10 and the apparatus DD are accommodated in a support frame 132. In particular, a set of dispensing bins 10 are provided as the top row on a shelf 134. The dispensing bins 10 are in the form of a pull-out drawer 136. As best shown in FIG. 7, the drawer 136 can be easily pulled out, but is prevented from falling out due to the upper rear constraint 74 engaging the recessed front support wall 138 of the frame 132.

Figure 8:
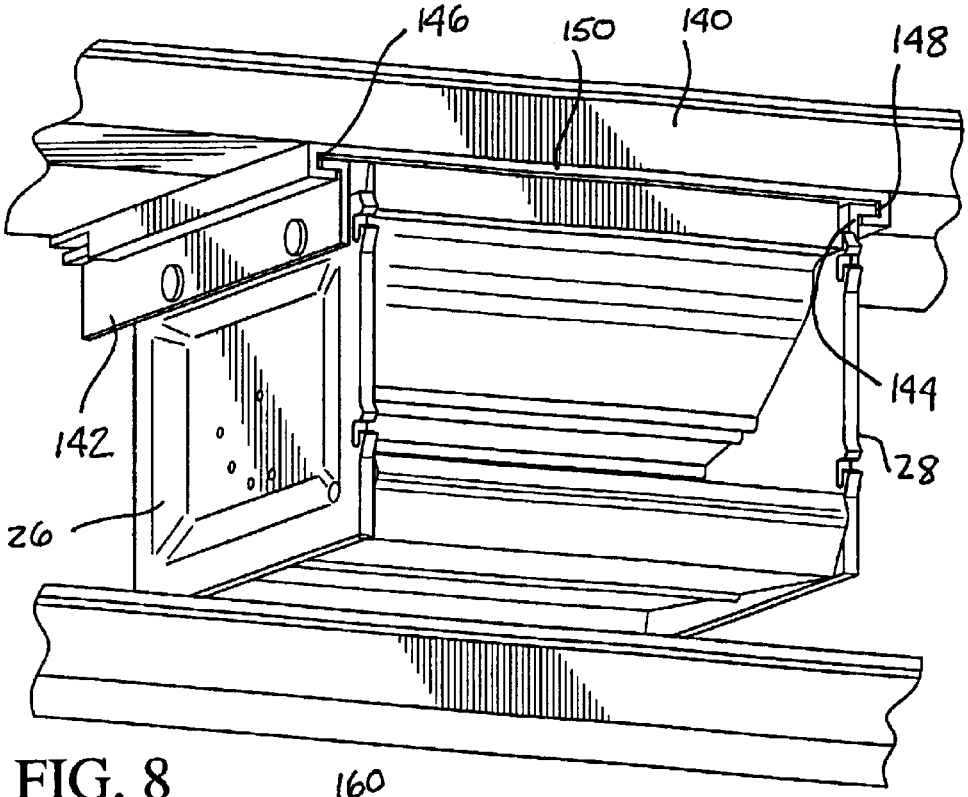
FIG. 8 illustrates the article dispensing apparatus of FIG. 1, without the front door and slidably suspended from a support.

FIG. 8 illustrates suspending or hanging the dispensing bin 10 from preferably an overhead support structure 140. As illustrated, left and right rails 142 and 144 are mounted on the left and right walls 26 and 28 of the dispensing bin 10, respectively. The rails 142 and 144 ride in corresponding left and right guide grooves 146 and 148 of a support plate 150 mounted on the structure 140. Although not shown, a suitable stop would be provided to prevent the dispensing bin 10 from falling out.

Figure 9:
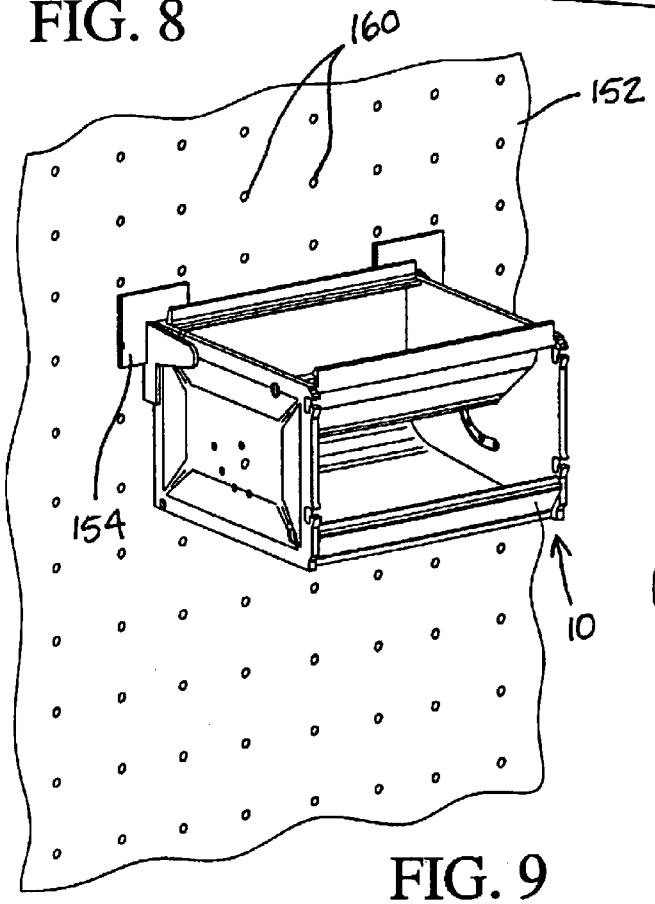
FIG. 9 illustrates the article dispensing apparatus of FIG. 1, without the front door and supported on a pegboard.
Figure 10:
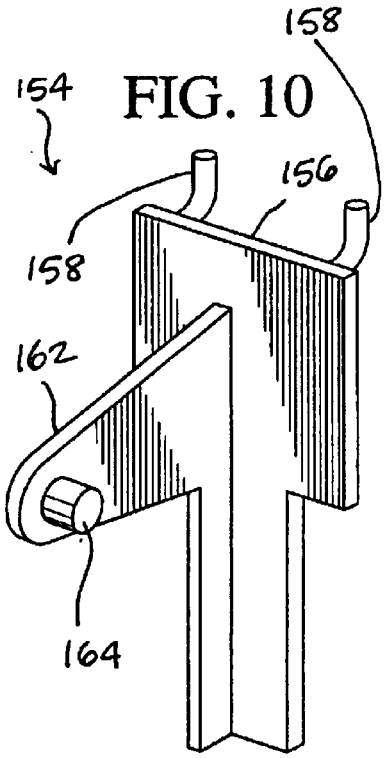
FIG. 10 is an enlarged perspective view of a bracket used in supporting the article dispensing apparatus of FIG. 1 on a pegboard, shown in FIG. 9.

FIGS. 9–10 illustrate an arrangement wherein the dispensing bin 10 can be supported on a pegboard 152 by using left and right identical brackets 154. As best shown in FIG. 10, the bracket 154 includes a back plate 156 with a pair of curved pins 158 to be received in the corresponding holes 160 in the pegboard 152. A front plate 162 extends generally at a right angle to the back plate 156 and includes support pin 164 to be received in connection holes 84 of the bin 10. The brackets 154 are preferably made from a thermoplastic or the like material.

Figure 15:
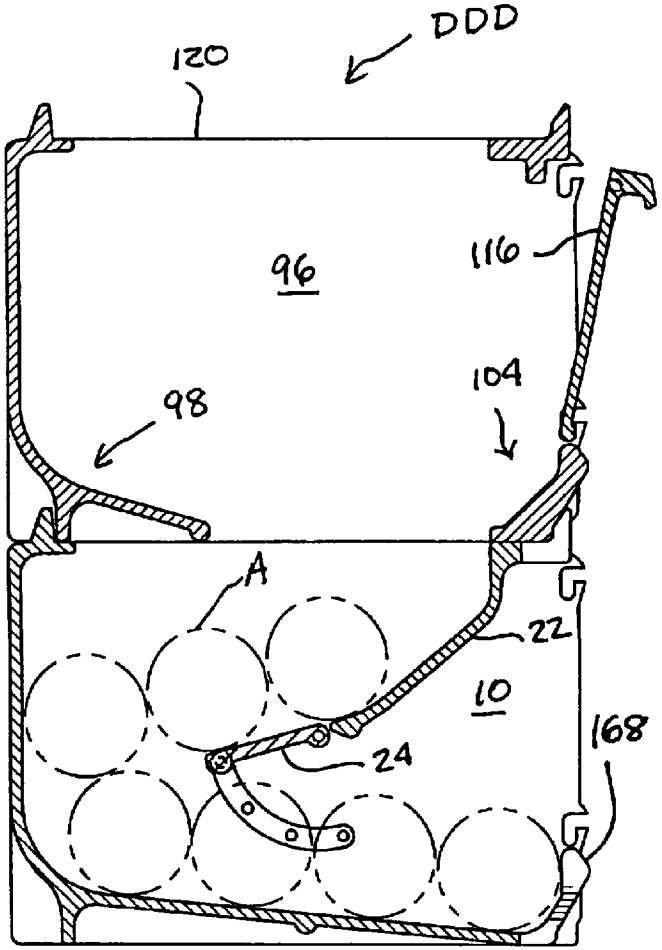
FIG. 15 is a sectional view taken along line 15—15 of FIG. 14.
Figure 14:
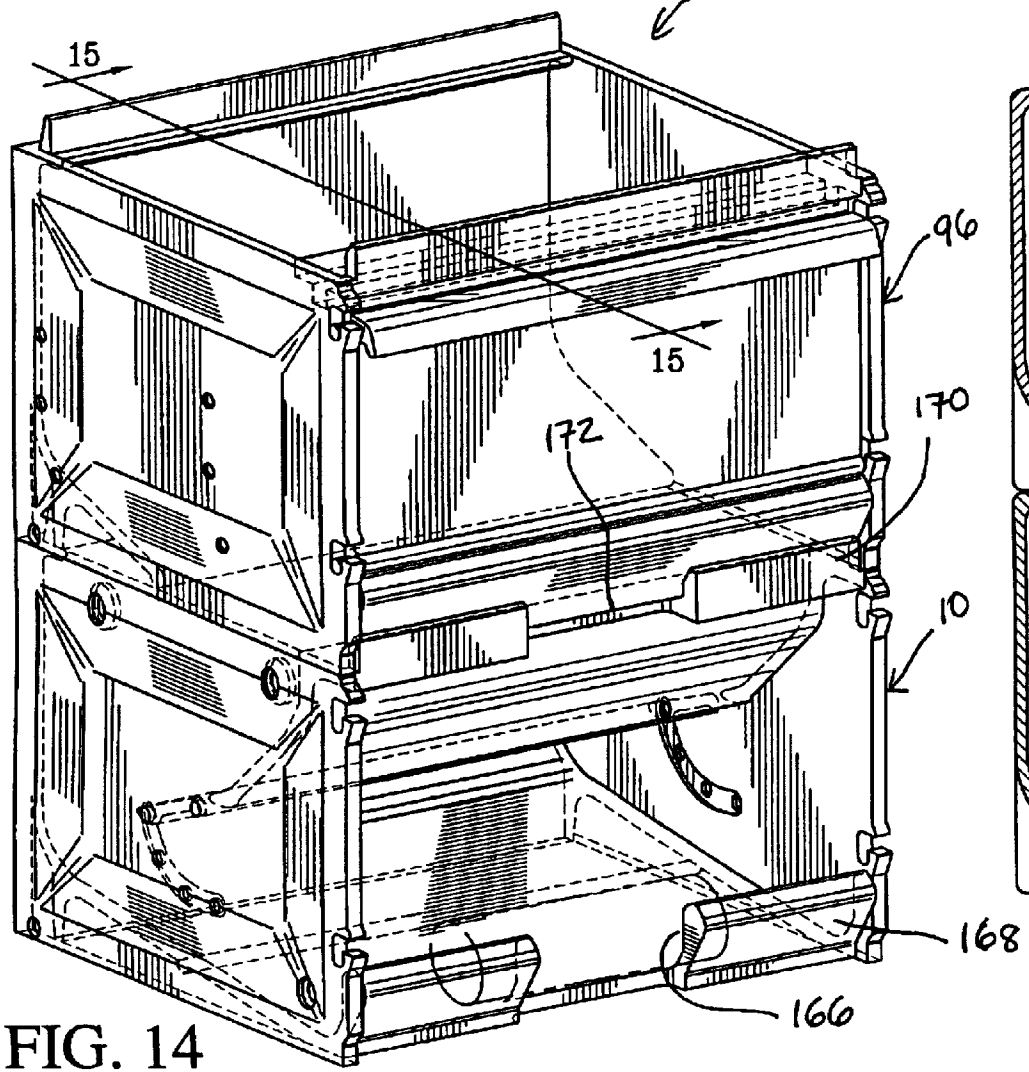
FIG. 14 is a perspective view of a third embodiment of an article dispensing apparatus in accordance with the present invention.

FIGS. 14–15 illustrate a third embodiment of the article dispensing apparatus DDD, which is similar to the embodiment disclosed in FIGS. 2–3, with the exception that an access notch 166 is provided, preferably centrally in the front catch 168 to facilitate grasping and removal of an article A. The front facade 170 also includes a similar notch 172 that is generally vertically aligned with the access notch 166. The purpose and function of the notch 172 in the front facade 170 can be readily observed from FIG. 16 wherein dispensing bins 10 are nested or stacked vertically. The notch 172 in the front facade 170 and the notch 166 in the catch 168, together provide an easy access and removal of articles A.

From the above, it can be readily observed that the dispensing bin 10, with or without a front door 56, can be used by itself to display and dispense articles of various sizes (FIG. 1). The load or storage capacity of the dispensing bin 10 can be increased by vertically nesting or stacking one or more of the expansion bins 96 atop thereof (FIG. 2). In addition, several dispensing bins 10 can be arranged in a horizontal array, with or without one or more expansion bins 96 atop thereof. Various other combinations may also be achieved. For example, dispensing bins 10 and expansion bins 96 can be arranged alternately in a vertical direction (FIGS. 5–6). More than one dispensing bins may also be arranged vertically (FIG. 16). Optionally, the dispensing bin 10 and/or expansion bin 96 may be provided with a front door, as desired. Further, the top opening of the dispensing bin 10, or the bin which is the top most bin in a vertical array may be provided with a suitable lid or cover to protect the articles from dust or other contamination.

The article dispensing apparatus of the present invention, therefore, provides modular flexibility in both vertical and horizontal directions without requiring the use of any additional parts or components. The structure and configuration of the article dispensing apparatus of the present invention provides many options and choices of various combinations for displaying and dispensing various articles. Particularly, since each dispensing bin and/or the expansion bin can be molded from plain or colored opaque or transparent material.

It can also be observed from the above that by adjusting the position of the feeder ramp 16 in the dispensing bin 10, articles of various sizes can be accommodated. Also, the overall size of the bins can be varied. Therefore, the same apparatus or unit can be used to display and dispense many different articles.

While this invention has been described as having preferred sequences, ranges, steps, materials, or designs, it is understood that it includes further modifications, variations, uses and/or adaptations thereof following in general the principle of the invention, and including such departures from the present disclosure as those come within the known or customary practice in the art to which the invention pertains, and as may be applied to the central features hereinbeforesetforth, and fall within the scope of the invention and of the limits of the appended claims.

What is claimed is:

1. An article dispensing apparatus, comprising:

a) a bin for storing articles to be dispensed therefrom;

b) said bin including a front, rear, left, right, top and bottom;

c) said bin including a first adjustable ramp for accommodating articles of various sizes;

d) said bin including a second ramp;

e) said first and second ramps extending between the front and rear of said bin;

f) one of said first and second ramps comprising a feeder ramp and the other of said first and second ramps comprising a return ramp; and g) said feeder ramp comprising a fixed ramp portion and an adjustable ramp portion.

2. The apparatus of claim 1, wherein:

a) said feeder ramp is adjustable relative to said return ramp.

3. The apparatus of claim 1, wherein:

a) said adjustable ramp portion is pivotable relative to said fixed ramp portion between first and second angular positions.

4. The apparatus of claim 3, wherein:

a) said feeder ramp is inclined downwardly from the front of said bin to the rear thereof; and b) said return ramp is inclined downwardly from the rear of said bin to the front thereof.

5. The apparatus of claim 4, wherein:

a) said fixed ramp portion is inclined at an angle of about 30–60°.

6. The apparatus of claim 5, wherein a) said fixed ramp portion is inclined at an angle of about 40°.

7. The apparatus of claim 5, wherein:

a) said return ramp is inclined at an angle of about 4–9°.

8. The apparatus of claim 7, wherein:

a) said return ramp is inclined at an angle of about 5°.

9. The apparatus of claim 7, wherein:

a) said return ramp includes a generally curved portion having a radius of curvature of about 0.75–1.5 inches.

10. The apparatus of claim 4, wherein:

a) one of said first and second angular positions of said adjustable ramp portion is inclined at an angle of about 10–20° from the horizontal.

11. The apparatus of claim 4, wherein:

a) said first and second angular positions are separated by an angle of up to 90°.

12. The apparatus of claim 4, wherein:

a) a predetermined gap is present between said adjustable ramp portion and said return ramp; and b) said gap is narrowed or enlarged when said adjustable ramp portion is pivoted relative to said fixed ramp portion.

13. The apparatus of claim 1, further comprising:

a) a catch adjacent the front of said bin.

14. The apparatus of claim 1, further comprising:

a) a door for opening or closing the front of said bin.

15. The apparatus of claim 14, wherein:

a) said bin is open at the top thereof.

16. The apparatus of claim 1, wherein:

a) said bin includes a notch in the front thereof for removing an article therefrom.

17. The apparatus of claim 1, further comprising:

a) means for attaching said bin to a support structure.

18. The apparatus of claim 17, wherein:

a) said attaching means comprises a rail member and a cooperating bracket; and a) said rail member is mounted on one of said bin and said support structure, and said cooperating bracket is mounted on the other of said bin and said support structure.

19. The apparatus of claim 18, wherein:

a) said bin is slidable relative to said structure.

20. The apparatus of claim 17, wherein:

a) said support structure comprises a peg board; and b) said attaching means comprises a bracket.

21. An article dispensing unit, comprising a plurality of dispensing apparatuses of claim 1.

22. An article dispensing apparatus, comprising:

a) a first bin for storing articles to be dispensed therefrom;

b) a second bin in operable engagement with said first bin for supplying articles to said first bin;

c) each of said first and second bins including a front, rear, left, right, top and bottom; and d) one of said first and second bins including a first adjustable ramp for accommodating articles of various sizes.

23. The apparatus of claim 22, wherein:

a) said second bin includes an inclined ramp for supplying articles to said first bin.

24. The apparatus of claim 23, wherein:

a) the top of said first bin and the bottom of said second bin include cooperating openings for moving articles from said second bin to said first bin.

25. The apparatus of claim 24, further comprising:

a) a door for opening or closing the front of said second bin.

26. The apparatus of claim 25, wherein:

a) said first bin includes a notch in the front thereof for removing an article therefrom.

27. The apparatus of claim 25, further comprising:

a) a plurality of said second bins; and b) a first one of said plurality of second bins is disposed atop said first bin and the remaining said second bins are stacked one atop the other.

28. The apparatus of claim 22, wherein:

a) said second bin includes a return ramp and a feeder ramp for supplying articles to said first bin.

29. The apparatus of claim 22, further comprising:

a) a plurality of said second bins.

30. The apparatus of claim 29, further comprising:

a) a plurality of said first bins.

31. The apparatus of claim 30, wherein:

a) said first and second bins are alternately disposed in a vertical direction.

32. The apparatus of claim 30, wherein:

a) a plurality of said first bins are disposed horizontally with at least one of said second bins disposed atop one of said first bins.

33. An article dispensing unit, comprising a plurality of dispensing apparatuses of claim 22.

34. The apparatus of claim 22, wherein:

a) said first bin includes said first adjustable ramp;

b) said first bin includes a second ramp; and c) said first and second ramps are disposed between the front and rear of said first bin.

35. The apparatus of claim 34, wherein:

a) one of said first and second ramps comprises a feeder ramp and the other of said first and second ramps comprises a return ramp.

36. The apparatus of claim 35, wherein:

a) said feeder ramp comprises a fixed ramp portion and an adjustable ramp portion.

37. The apparatus of claim 36, wherein:

a) said adjustable ramp portion is pivotable relative to said fixed ramp portion between first and second angular positions.

38. The apparatus of claim 37, wherein:

a) said feeder ramp is inclined downwardly from the front of said first bin to the rear thereof; and b) said return ramp is inclined downwardly from the rear of said first bin to the front thereof.

39. The apparatus of claim 38, wherein:

a) one of said first and second angular positions of said adjustable ramp portion is inclined at an angle of about 10–20° from the horizontal.

40. The apparatus of claim 38, wherein:

a) said first and second angular positions are separated by an angle of up to 90°.

41. The apparatus of claim 38, wherein:

a) a predetermined gap is present between said adjustable ramp portion and said return ramp; and b) said gap is narrowed or enlarged when said adjustable ramp portion is pivoted relative to said fixed ramp portion.

42. The apparatus of claim 22, further comprising:

a) first and second interlocking members for locking said first and second bins together.

43. The apparatus of claim 42, wherein:

a) said first and second interlocking members comprise tongue and groove members; and b) one of said first and second bins comprises said tongue member and the other of said first and second bins comprises said groove member.

44. An article dispensing unit, comprising:

a) a support structure defining a recess;

b) an article dispensing apparatus disposed in said recess; and c) said article dispensing apparatus, comprising;

i) a first bin for storing articles to be dispensed therefrom;

ii) a second bin in operable engagement with said first bin for supplying articles to said first bin;

iii) each of said first and second bins including a front, rear, left, right, top and bottom; and iv) one of said first and second bins including a first adjustable ramp for accommodating articles of various sizes.

45. The article dispensing unit of claim 44, wherein:

a) one of said first and second bins is slidable relative to said support structure.

46. The article dispensing unit of claim 44, comprising a plurality of said article dispensing apparatuses.

* * * * *